US009623449B2

(12) United States Patent
Avoyan et al.

(10) Patent No.: US 9,623,449 B2
(45) Date of Patent: Apr. 18, 2017

(54) DIELECTRIC WINDOW CLEANING APPARATUSES

(75) Inventors: Armen Avoyan, Oakland, CA (US); Hong Shih, Walnut, CA (US); Cliff LaCroix, Livermore, CA (US); John Daugherty, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 1282 days.

(21) Appl. No.: 13/442,223

(22) Filed: Apr. 9, 2012

(65) Prior Publication Data

US 2013/0263897 A1 Oct. 10, 2013

(51) Int. Cl.
*B08B 3/02* (2006.01)

(52) U.S. Cl.
CPC ..... *B08B 3/024* (2013.01); *B08B 3/022* (2013.01)

(58) Field of Classification Search
USPC ..... 134/1.1, 153
See application file for complete search history.

(56) References Cited

U.S. PATENT DOCUMENTS

| | | | | |
|---|---|---|---|---|
| 3,031,195 | A | 4/1962 | Lunsford | |
| 4,788,994 | A * | 12/1988 | Shinbara | 134/157 |
| 5,226,967 | A | 7/1993 | Chen et al. | |
| 5,568,015 | A | 10/1996 | Holber et al. | |
| 5,785,068 | A | 7/1998 | Sasaki et al. | |
| 5,788,799 | A * | 8/1998 | Steger et al. | 156/345.37 |
| 6,074,516 | A | 6/2000 | Howald et al. | |
| 6,260,562 | B1 | 7/2001 | Morinishi et al. | |
| 6,374,831 | B1 | 4/2002 | Chandran et al. | |
| 6,666,982 | B2 | 12/2003 | Brcka | |
| 7,252,099 | B2 | 8/2007 | Chen et al. | |
| 2003/0079764 | A1 | 5/2003 | Hirose et al. | |
| 2008/0041430 | A1 | 2/2008 | Cho et al. | |
| 2009/0250079 | A1 | 10/2009 | Yoshihara et al. | |

(Continued)

FOREIGN PATENT DOCUMENTS

WO WO 2006025639 A1 * 3/2006

OTHER PUBLICATIONS

W. Puyrenier, et al., Characterization of the impact of plasma treatments and wet cleaning on a porous low k material, Microelectronic Engineering 83, 2006, 2314-2318, Elsevier B.V.

(Continued)

*Primary Examiner* — Michael Barr
*Assistant Examiner* — Rita Adhlakha
(74) *Attorney, Agent, or Firm* — Beyer Law Group LLP

(57) ABSTRACT

A dielectric window cleaning apparatus may be used for cleaning a dielectric window of a plasma processing device. The dielectric window cleaning apparatus may comprise a window support base, a fluid containing enclosure, a window rotating mechanism, a spray arm, and multiple fluid spraying nozzles. The fluid containing enclosure may include at least one overflow containment sidewall and may be located at least partially under and at least partially around a portion of the window support base. The window rotating mechanism may be operatively connected to the window support base and may rotate the window support base. The spray arm may be in fluid communication with a fluid source and may include a fluid flow channel. The multiple fluid spraying nozzles may each expel fluid from the fluid flow channel in a window cleansing spray.

18 Claims, 7 Drawing Sheets

(56) References Cited

U.S. PATENT DOCUMENTS

| | | | | |
|---|---|---|---|---|
| 2010/0122772 | A1 | 5/2010 | Hayashi | |
| 2010/0267317 | A1* | 10/2010 | Takahashi et al. | 451/388 |
| 2013/0068248 | A1* | 3/2013 | Yeh et al. | 134/3 |

OTHER PUBLICATIONS

International Search Report and Written Opinion, dated Nov. 13, 2013, relating to International Application No. PCT/US2013/030404.

* cited by examiner

DIELECTRIC WINDOW CLEANING APPARATUSES

TECHNICAL FIELD

The present specification generally relates to cleaning apparatuses and, more specifically, to cleaning apparatuses for cleaning dielectric windows of plasma processing devices with a fluid spray.

BACKGROUND

Plasma processing devices can be utilized to etch material away from a substrate formed from, for example, a semiconductor or glass. Plasma processing devices may contain a vacuum chamber that encloses plasma processing gases, which can be ionized and transformed into plasma. For example an energized source (radio frequency (RF), microwave or other source) can apply energy to the process gas to generate the plasma. In some plasma processing devices, the energy can be transmitted through a dielectric window that is formed through the vacuum chamber. The dielectric window may be made of a dielectric material such as quartz. Through operation of the plasma processing device, the dielectric window is exposed to vacuum chamber conditions, which may cause contaminants to accumulate on the vacuum chamber side surface of the dielectric window. Such contaminants may be undesirable for the continued operation and performance of the plasma processing device.

Accordingly, a need exists for a dielectric window cleaning apparatus to provide for effective cleaning of dielectric windows.

SUMMARY OF THE INVENTION

In one embodiment, a dielectric window cleaning apparatus may be used for cleaning a dielectric window of a plasma processing device. The dielectric window cleaning apparatus may comprise a window support base, a fluid containing enclosure, a window rotating mechanism, a spray arm, and multiple fluid spraying nozzles. The window support base may include a window contacting surface. The fluid containing enclosure may include at least one overflow containment sidewall. The fluid containing enclosure may be located at least partially under and at least partially around a portion of the window support base. The window rotating mechanism may be operatively connected to the window support base. The window rotating mechanism may rotate the window support base. The spray arm may be in fluid communication with a fluid source and may include a fluid flow channel. The spray arm can include an operational position and a loading position. When the spray arm is positioned in the operational position the fluid flow channel can be at least partially disposed directly above the window support base. When in the loading position the fluid flow channel is not disposed directly above the window support base. The multiple fluid spraying nozzles may each expel fluid from the fluid flow channel in a window cleansing spray. The window cleansing spray from one of the fluid spraying nozzles may overlap with the window cleansing spray of at least another fluid spraying nozzle.

BRIEF DESCRIPTION OF THE DRAWINGS

The following detailed description of specific embodiments can be best understood when read in conjunction with the following drawings, where like structure is indicated with like reference numerals and in which.

DETAILED DESCRIPTION

As is noted above, the present disclosure relates to dielectric window cleaning apparatuses. The concepts of the present disclosure should not be limited to particular dielectric window configurations. Although the present disclosure is not limited to particular types of dielectric windows or the context in which the dielectric windows to be cleaned have been used, for the purposes of illustration, the dielectric window cleaning apparatus is illustrated and described herein with reference to quartz dielectric windows, such as disc-shaped quartz dielectric windows. However, suitable dielectric materials include quartz and ceramics comprising, for example, Aluminum nitride (AlN), Aluminum oxide ($Al_2O_3$), or any other refractory material having similar transmissive properties. Further teachings regarding the structure of dielectric windows similar to that illustrated in FIG. 1 as resting on the dielectric window cleaning apparatus can be found in U.S. Pat. No. 5,226,967, pertinent portions of which are incorporated herein by reference.

Although the particular features of the dielectric window cleaning apparatus illustrated herein may vary, particular configurations according to the present disclosure are illustrated herein with reference to FIGS. 1-9. Generally, the dielectric window cleaning apparatus comprises a window support base, a fluid containing enclosure, a window rotating mechanism, and a spray arm. Each of the above mentioned components of the dielectric window cleaning apparatus may be disposed on a frame. The window rotating mechanism rotates the window support base upon which a dielectric window rests, causing the dielectric window to rotate. The spray arm expels a window cleansing spray onto the rotating dielectric window which cleans the dielectric window of at least some contaminants disposed on the top surface of the dielectric window.

Figure 1:
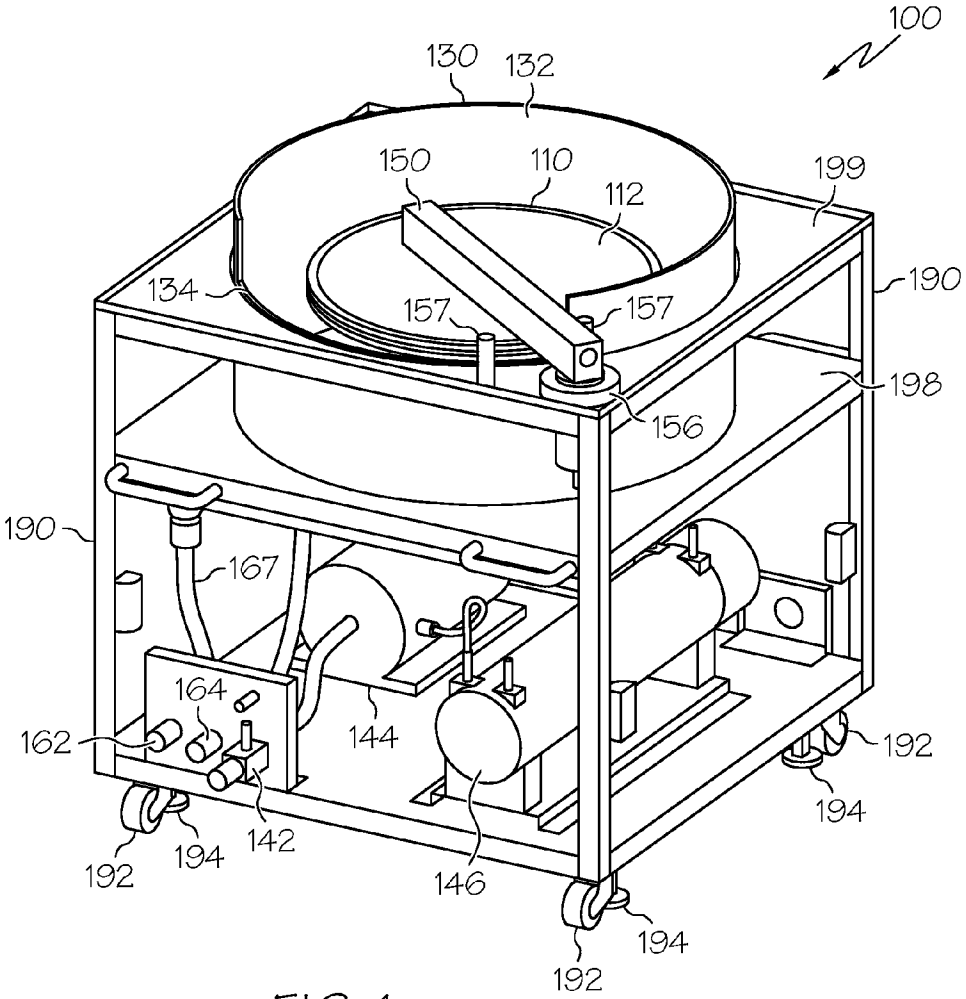
FIG. 1 illustrates a schematic view of a dielectric window cleaning apparatus with a dielectric window disposed on the window support base according to one or more embodiments described herein.
Figure 3:
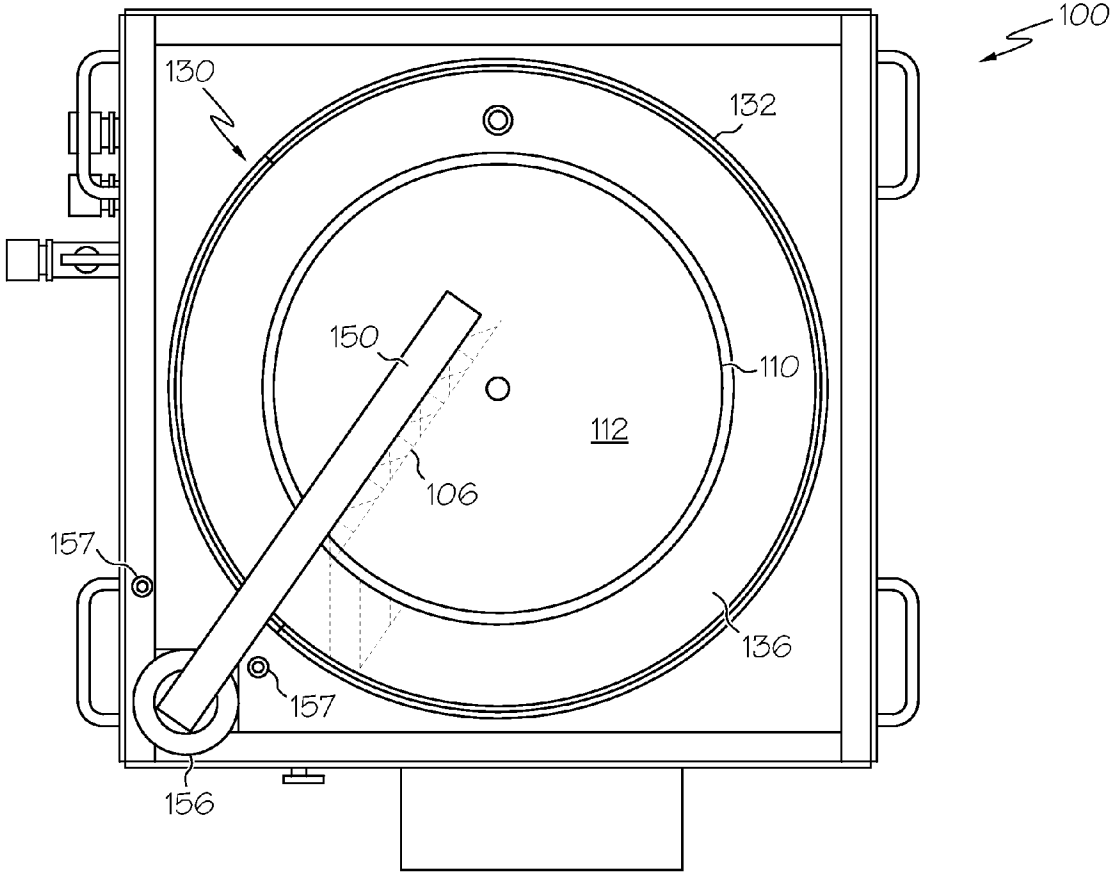
FIG. 3 illustrates a schematic top view of the dielectric window cleaning apparatus of FIG. 2 according to one or more embodiments described herein.
Figure 4:
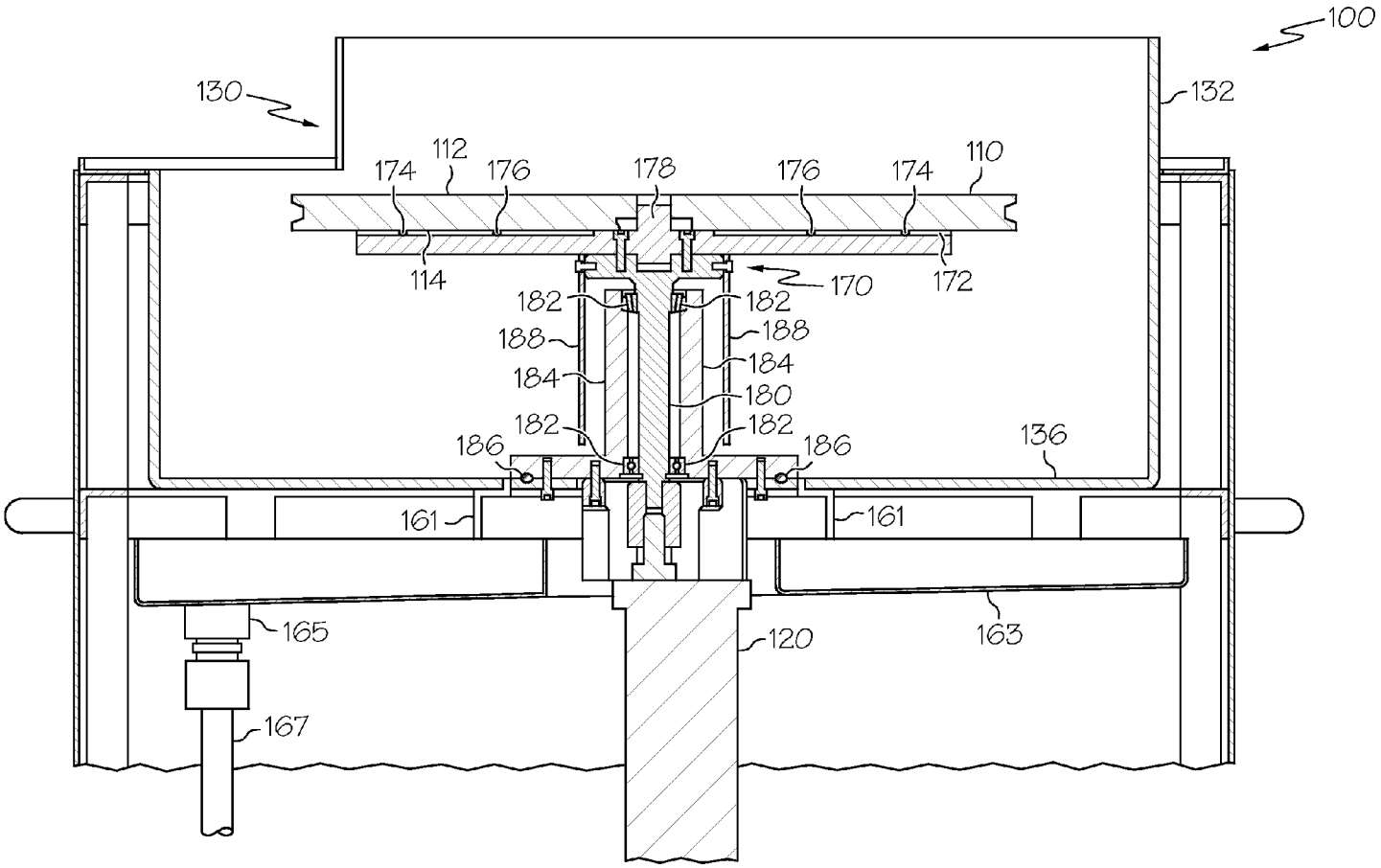
FIG. 4 illustrates a cross sectional cut-away schematic view of the dielectric window cleaning apparatus of FIG. 1 according to one or more embodiments described herein.

Referring to FIGS. 1, 3, and 4, a schematic view of a dielectric window cleaning apparatus 100 is depicted. The dielectric window cleaning apparatus 100 supports a dielectric window 110 that rests on a window support base 170 (located under the dielectric window 110 in FIGS. 1 and 3). The dielectric window 110 may comprise any dielectric material. For example, the dielectric window 110 may be a disk-shaped quartz material. It may be desirable to clean at least one surface of a dielectric window 110, such as the top surface 112, when a coating of contaminants has built up on the surface of the dielectric window 110. For example, the top surface 112 of the dielectric window 110 may be the plasma exposed surface of the dielectric window 110. Accordingly, the top surface 112 of the dielectric window 110 may have a coating of at least one contaminant such as yttrium, caused by exposure to plasma and/or plasma processing gases. Further contaminants can be generated by plasma processing gasses having halogens or halogen elements such as, for example, fluorine (F), chlorine (Cl), bromine (Br), iodine (I), and astatine (At). Specifically, the process gases may be, but are not limited to, $CClF_3$, $C_4F_8$, $C_4F_6$, $CHF_3$, $CH_2F_3$, $CF_4$, HBr, $CH_3F$, $C_2F_4$, $N_2$, $O_2$, Ar, Xe, He, $H_2$, $NH_3$, $SF_6$, $BCl_3$, $Cl_2$, and other gases capable of being ionized.

In one embodiment, the dielectric window 110 can be substantially disk shaped with diameter of about 20 inches. In another embodiment, the dielectric window 110 may be disk shaped with a diameter of about 22 inches to accommodate similarly sized wafers. However, it should be understood that the dielectric window 110 may have a diameter of greater than about 22 inches to accommodate wafers of increased size. The dielectric window 110 may weigh greater than or equal to about 40 lbs., or even greater than or equal to about 50 lbs. In one embodiment, the dielectric window weighs about 54 lbs. However, it should be understood that the dielectric window 110 that is cleaned by the dielectric window cleaning apparatus 100 may be of any size and/or shape, such as any dielectric window that would be used in a plasma processing device.

Now referring to FIG. 4, a cross sectional schematic view of a dielectric window cleaning apparatus 100 is depicted. The dielectric window cleaning apparatus 100 comprises a window support base 170 that supports the dielectric window 110. The window support base 170 has a window contacting surface 172 that may be substantially flat, such that dielectric window 110 having a disk shape may rest on the window contacting surface 172. However, the window contacting surface 172 may be of any shape or contour such that the dielectric window 110 can rest stably on the window contacting surface 172. For example the window contacting surface 172 may only contact the dielectric window 110 on raised portions, such as o-rings 174,176. In one embodiment, at least one o-ring 174,176 may be on the window contacting surface 172 and in contact with the dielectric window 110, wherein the o-ring 174,176 is placed between a flat surface of the window support base 170 and the underside of the dielectric window 114. The o-rings 174,176 may be a mechanical gasket in the shape of a torus. The o-rings 174,176 can be formed from a loop of elastomer with a disc-shaped cross-section. Without being bound by theory, it is believed that one or more o-rings 174,176 positioned on the window contacting surface 172 and contacting the dielectric window 110 reduces scratching and other marring on the dielectric window 110. For example, the o-rings 174,176 can mitigate sliding of the dielectric window 110 relative to the window contacting surface 172, while the window support base 170 of the dielectric window cleaning apparatus 100 is rotating. It is also believed that the at least one o-ring 174,176 forms a seal between the underside of the dielectric window 114 and the window contacting surface 172 which can substantially prevent contact of the window cleansing spray 106 with the underside 114 of the dielectric window 110.

The window contacting surface 172 may be substantially circularly shaped and may have a smaller diameter that the dielectric window 110 that it supports. Alternatively, the window contacting surface may be about the same diameter as the dielectric window 110 that it supports, or may have a larger diameter than the dielectric window 110 that it supports. The window support base 170 may comprise a window centering post 178, which protrudes from the window contacting surface 172 at or near the center of the window contacting surface 172. In one embodiment, the window centering post 178 may be contoured to fit an opening or aperture of the center of a disc shaped dielectric window 110. The window centering post 178 thus may center the dielectric window 110 on the window contacting surface 172 and may restrict the movement of the dielectric window 110 relative to the window contacting surface 172 when the dielectric window 110 is positioned on the window contacting surface 172 and rotated.

Still referring to FIG. 4, in one embodiment, the window support base 170 comprises a base supporting shaft 180 which extends in the vertical direction and connects to the window contacting surface 172. The base supporting shaft 180 may be positioned in the axial center of the window contacting surface 172, such as directly below the window centering post 178. A window rotating mechanism 120 is operatively connected to the window support base 170, wherein the window rotating mechanism 120 is capable of rotating the window support base 170 around a central axis. The window rotating mechanism 120 may be an electric or fuel powered motor, or any like device capable of rotating the window support base 170. In one embodiment, the window rotating mechanism 120 is operatively connected to the window support base 170 at the base supporting shaft 180. However, it should be understood that the window rotating mechanism 120 may be operatively connected to any part of the window support base 170 such that it can rotate the window support base 170.

Figure 8:
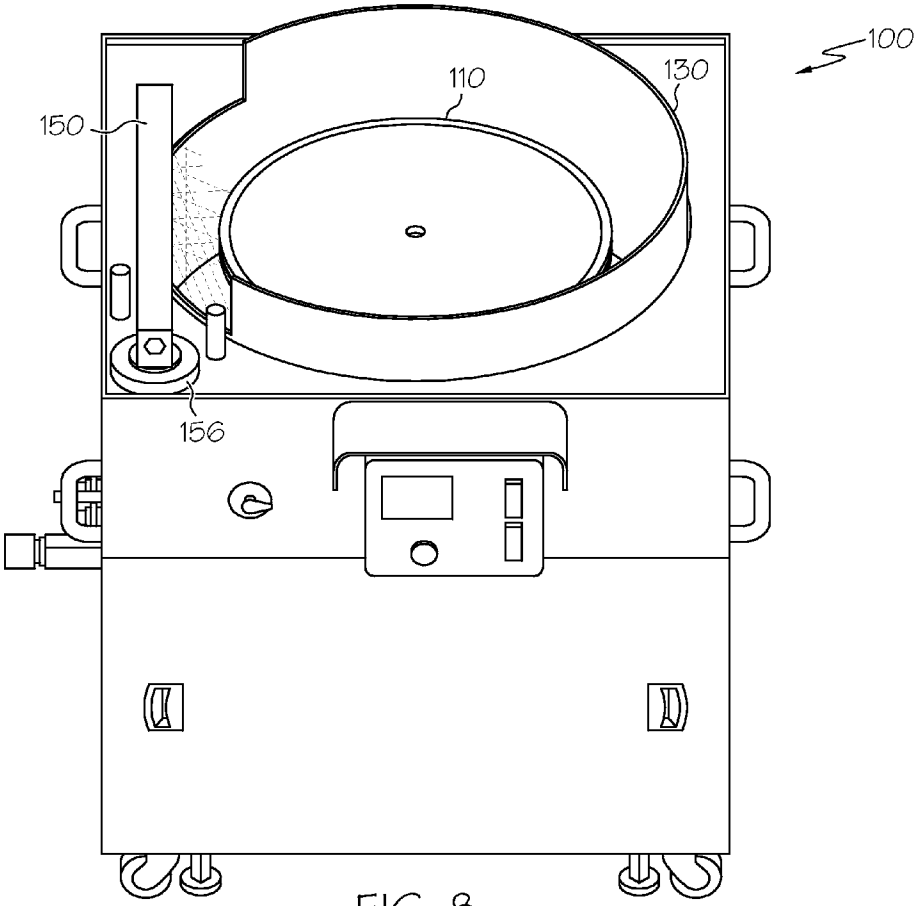
FIG. 8 illustrates a schematic view of the dielectric window cleaning apparatus of FIG. 2 in the loading position according to one or more embodiments described herein.

Referring now to FIGS. 1 and 3, the dielectric window cleaning apparatus 100 comprises a spray arm 150. The spray arm is in fluid communication with a fluid source, such as a fluid inlet valve 142 that brings in a fluid from outside of the dielectric window cleaning apparatus 100. The fluid communication may be provided through a pipe, tubing, or other like means that can transport a fluid. The spray arm 150 may be coupled to a pivoting mount 156, which allows the spray arm to pivot on a rotational axis between an operational position and a loading position. The spray arm 150 is positioned in the operational position when it is at least partially disposed directly above the window support base in the area where a dielectric window 110 would rest, such as is depicted in FIGS. 1 and 3. The spray arm 150 is positioned in the loading position when it is not positioned directly above the window support base. For example, the loading position is depicted in FIG. 8. In the loading position, the dielectric window can be loaded and unloaded onto and off of the window support base 170 without interference from the spray arm 150.

Referring again to FIGS. 1 and 3, the pivoting movement of the spray arm 150 may be restricted by mechanical means, such as one or more spray arm guideposts 157. The spray arm guideposts 157 work as a system with the pivoting spray arm 150 to block the movement of the spray arm 150 from outside of the operational position or loading position. Specifically, the spray arm guideposts 157 may restrict the spray arm 150 from moving outside of the framework of the dielectric window cleaning apparatus 100. The spray arm guideposts 175 may also help position the spray arm 150 in a preferred position over the dielectric window 110, such that when the dielectric window 110 spins in a single revolution, all of the top surface 112 can be contacted by the window cleansing spray 106 expelled from the spray arm 150. The spray arm 150 may be capable of being positioned in the operational position and maintaining its position in the operational position throughout the washing operation wherein fluid is expelled from the spray arm 150. In some embodiments, the spray arm 150 may be disposed about 0.5 inches to about 3 inches above the dielectric window top surface 112, and in one embodiment is disposed about 1.8 inches above the dielectric window top surface 112. However, the spray arm's height above the dielectric window 110 may be adjustable, such as to accommodate dielectric windows 110 of varying disk thickness, or to adjust the distance between the nozzles of the spray arm 150 and the dielectric window 110 to affect the mechanical properties of the window cleansing spray 106.

Figure 7:
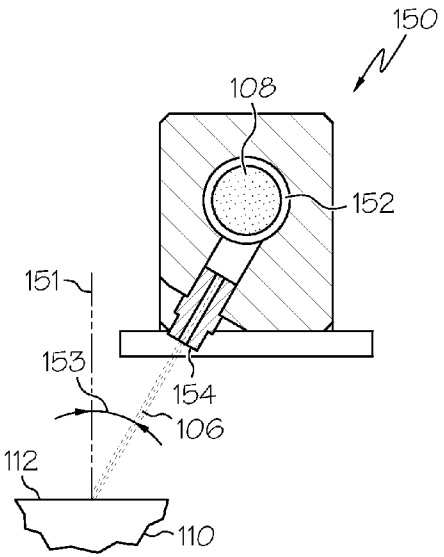
FIG. 7 illustrates an exploded schematic cross sectional view of the width of the spray arm of FIG. 5 according to one or more embodiments described herein.
Figure 5:
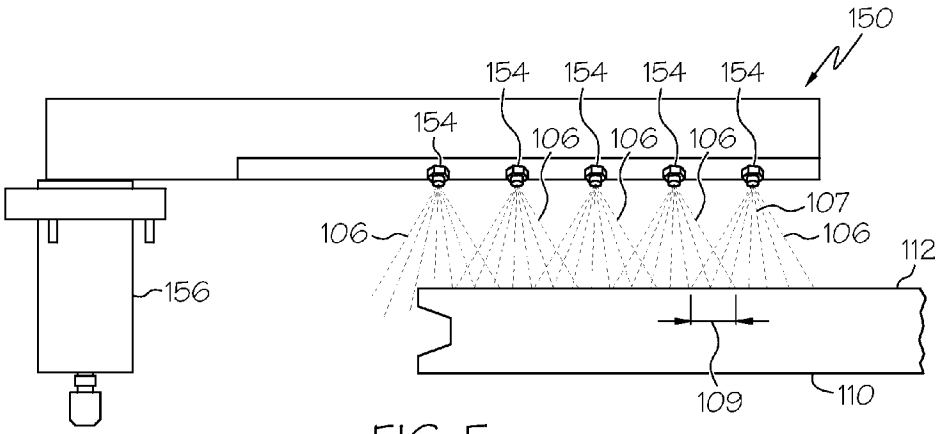
FIG. 5 illustrates a schematic view of a spray arm of the dielectric window cleaning apparatus of FIG. 1 according to one or more embodiments described herein.
Figure 6:
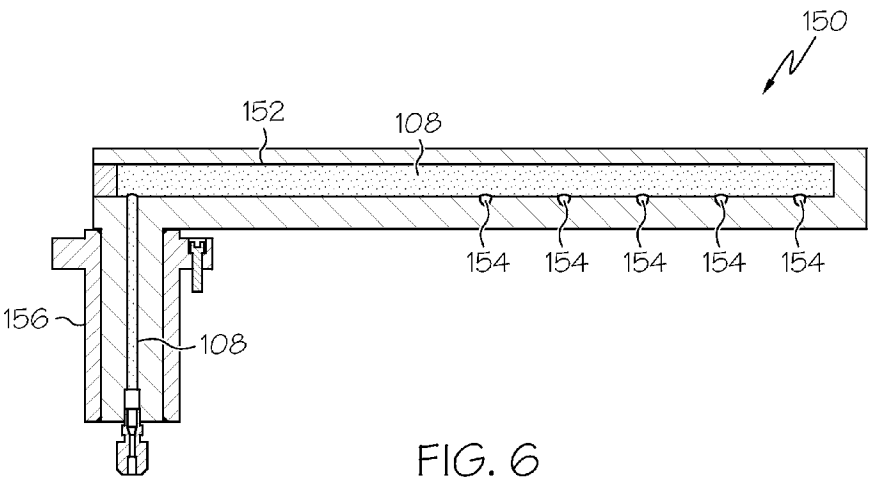
FIG. 6 illustrates a schematic cross sectional view of the length of the spray arm of FIG. 5 according to one or more embodiments described herein.

Now referring to FIGS. 5-7, the spray arm 150 comprises a fluid flow channel 152 that may be a generally linear conduit in the spray arm that allows the flow of a fluid 108 through the interior of the spray arm 150. The spray arm 150 comprises multiple fluid spraying nozzles 154 that each can expel a fluid 108 in a window cleansing spray 106. In one embodiment, the fluid spraying nozzles 154 are positioned down the length of the spray arm 150, and are evenly spaced from one another. The fluid spraying nozzles 154 may be made of plastic or other like materials and may be capable of expelling fluid 108 in a window cleansing spray 106 in various shapes and patterns at various applied pressures of the fluid 108. When the dielectric window cleaning apparatus 100 is in operation, fluid 108 is expelled from the fluid spraying nozzles 154 in window cleansing sprays 106 wherein the fluid 108 flows from a fluid source through the fluid flow channel 152 and through the fluid spraying nozzles 154 and at least partially onto the dielectric window 110 positioned on the window support base 170.

Each of the fluid spraying nozzles 154 may spray a window cleansing spray 106 having a substantially flat shape towards the dielectric window 110 on the window support base. A substantially flat shape means that the width of the window cleansing spray 106 in a first dimension is substantially greater than the width of the window cleansing spray 106 in a perpendicular dimension. For example, the width of the window cleansing spray 106 from each fluid spraying nozzle 154 in FIG. 5, along the length of the spray arm 150, is substantially wider than the width of the window cleansing spray 106 in the perpendicular direction, as depicted in FIG. 7. For a flat spray, the ratio of the width of spray one direction compared with the width of the spray in a perpendicular direction may be about 10:1. In one embodiment, the ratio for a substantially flat spray may be about 5:1. In another embodiment, the ratio for a substantially flat spray may be about 15:1. In yet another embodiment, the ratio for a substantially flat spray may be about 20:1.

As shown in FIGS. 5 and 7, in one embodiment, each of the fluid spraying nozzles 154 may spray window cleansing spray 106 having a substantially fan shape towards the dielectric window 110. The fan is defined by an apex 107 near the fluid spraying nozzle 154 wherein the width of the window cleansing spray 106 substantially broadens in one dimension as the window cleansing spray 106 is expelled away from the fluid spraying nozzle 154. When the window cleansing spray 106 is fan shaped, the window cleansing spray 106 has a substantially larger width in one direction where it contacts the dielectric window than at the fluid spraying nozzle 154. For example, the window cleansing spray 106 may emanate from a fluid spraying nozzle 154 head and broaden by about 20 times the cross sectional width of the fluid spraying nozzle 154. The fan shape may be defined by the angle of the width of the fluid cleansing spray 106 that emanates from the fluid spraying nozzle 154. For example, the spray may broaden from the apex 107 to from between about a 10° and about 70° angle of fluid spray.

Alternatively, the window cleansing spray 106 may project out of the fluid spraying nozzle 154 and widen in both dimensions, such as to form a substantially conical spray shape. The spray 106 may alternatively widen at different rates in the two dimensions, such as to form a substantially eliptical based conical shape. In other embodiments, the spray 106 may be non-symmetrical.

Now referring to FIG. 5, in one embodiment the window cleansing spray 106 from one fluid spraying nozzle 154 overlaps with the window cleansing spray 106 of at least another fluid spraying nozzle 154. For example, the window cleansing spray 106 from each fluid spraying nozzle 154 may overlap with the window cleansing spray 106 from an adjacent fluid spraying nozzle 154 in the overlap space 109. The overlap space 109 of two adjacent sprays 106 from two adjacent fluid spraying nozzles 154 may be measured by a percentage of the width of the spray 105 that is overlapping at the point where the window cleansing spray 106 makes contact with the dielectric window surface 112. For example, in one embodiment, the window cleansing spray 106 from each fluid spraying nozzle 154 overlaps by about 20%, meaning that overlap space 109 is 20% of the width of the window cleansing spray 106 from a fluid spraying nozzle 154 at the dielectric window surface 112. If a fluid spraying nozzle 154 is equally spaced between two other fluid spraying nozzles 154, a 20% overlap from each adjacent nozzle would mean that the middle nozzle's window cleansing spray 106 is actually overlapped on each side by 20%, causing a 40% total overlap from both adjacent fluid spraying nozzles 154. The window cleansing spray 106 from a fluid spraying nozzle 154 may overlap the window cleansing spray 106 of an adjacent fluid spraying nozzle 154 by about 15% to about 30% at the surface of the dielectric window 110, or even may overlap from about 10% to about 40%. It should be understood that the overlap and shape of the window cleansing spray 106 may be affected by fluid pressure as it is expelled through the fluid spraying nozzles 154, and that various spray shapes and nozzle spray overlap may be suitable for various dielectric window cleaning processes.

In some embodiments, the window cleansing spray 106 may be sprayed from a plurality of fluid spraying nozzles 154 that spray a flat spray, forming a substantially flat wall of fluid. For example, multiple window cleansing sprays 106 may be aligned such that they are arranged in the same direction with overlap to form a flat wall of fluid spray. In this embodiment, the fluid spraying nozzles 154 may be aligned in a linear row down the length of the spray arm 150, wherein the fan-shaped window cleansing spray 106 is widened in the same direction in each of nozzle sprays, such as in the same direction as the length of the spray arm 150.

As depicted in FIG. 7, the fluid spraying nozzles 154 may be positioned to expel the window cleansing spray 106 in a non-normal direction relative to the top surface of the dielectric window. For example, a fan-shaped window cleansing spray 106 may be projected at an angle 153 relative to a line 151 formed normal to the top surface of the dielectric window 112. However, it should be understood that the angle 153 may be acute, such as, for example, about 30°. In one embodiment the angel 153 is about 45°. In another embodiment, the angle 153 is about 15°.

Now referring to FIGS. 1 and 3, prior to entering the spray arm 150, the fluid flows through an upstream system wherein the fluid flows from a fluid inlet valve 142 to the spray arm 150 where it is expelled onto the dielectric window 110. The upstream system may comprise tubing, piping, or any other like fluid transport means to connect the fluid flow channel 152 of the spray arm 150 with the fluid inlet valve 142. The upstream system may further comprise at least one pump 144 and/or at least one heat exchanger 146. In one embodiment, the fluid inlet 142 may be in fluid communication via tubing with a pump 144, which may be in fluid communication via tubing with a heat exchanger 146, which may be in fluid communication via tubing with the spray arm 150. The heat exchanger 146 may be capable of changing the temperature of the fluid inlet stream that enters the fluid inlet 142 from an external source. The pump 144 may alter the pressure of the fluid stream that enters the fluid inlet 142 from an external source and is expelled from the spray arm 150. The upstream system may comprise shut-off valves, such as a shut off valve at the fluid inlet and/or a shut-off valve between the heat exchanger and the spray arm 150. However, while one embodiment is provided in this description and in the figures, it should be understood that the fluid to be sprayed by the spray arm may be transported from an outside source by any suitable means.

Now referring to FIGS. 1 and 4, a fluid containing enclosure 130 is positioned at least partially under and at least partially around a portion of the window support base 170. The fluid containing enclosure 130 captures and contains at least some of the fluid expelled from the spray arm 150 in the window cleansing spray 106. The fluid containing enclosure 130 includes at least an overflow containment sidewall 132, which contains the fluid that is sprayed from the spray arm 150 so that the fluid can be drained from the dielectric window cleaning apparatus 100 out of at least one fluid outlet 162,164. The overflow containment sidewall 132 may be cylindrically shaped or be of any other suitable shape such as to contain fluid that sprays from the spray arm 150. In one embodiment, the overflow containment sidewall 132 is substantially cylindrical and partially surrounds the window support base 170, such that when the fluid contacts a dielectric window 110, the fluid falls from the edge of the dielectric window and is captured within the confines of the overflow containment sidewall 132. The fluid containing enclosure 130 may comprise an impermeable bottom 136 joined to the overflow containment sidewall 132, such as to form a tank or reservoir area which may hold expelled fluid from the window cleansing spray. The fluid containing enclosure 130 may be constructed from a material that is impermeable to water and other fluids that are sprayed onto the dielectric window 110, such as a plastic or other polymer, ceramic or metallic material. The overflow containment sidewall may comprise a notch 134 which allows for pivoting movement of the spray arm 150.

At least partially within the fluid containing enclosure 130, the dielectric window cleaning apparatus 100 may comprise an inner shaft housing 184 that is substantially impermeable to fluid and disposed around the base supporting shaft 180. The inner shaft housing 184 may be secured to the bottom of the fluid containing enclosure 136 and may have at least one o-ring 186 which forms a substantially impermeable barrier between the base supporting shaft 180 and the fluid in the fluid containing enclosure 130. The inner shaft housing 184 may form a fluid barrier between the shaft and the fluid in the fluid containing enclosure 130 at least up to the height of the inner shaft housing 184, which in one embodiment is near the top of the base supporting shaft 180. In one embodiment, within and/or between the inner shaft housing 184 and the base supporting shaft 180 may be disposed roller bearings 182 which cooperate with the base supporting shaft 180 and the inner shaft housing 184 to reduce friction as the base supporting shaft 180 is rotated by the window rotating mechanism 120.

The dielectric window cleaning apparatus 100 may comprise an outer shaft housing 188 which is disposed around the inner shaft housing 184 and extends downward from the window contacting surface 172, leaving a fluid passage near the bottom of the inner shaft housing 184. The outer shaft housing 188 may cooperate with the inner shaft housing 184 to impede fluid from contacting the base supporting shaft 180 and roller bearings 182. The outer shaft housing 188 is impermeable by fluids, and allows fluid flow to the exterior side of the inner shaft housing 184 through an opening between the outer shaft housing 188 and the bottom of the inner shaft housing 184, which in some embodiments may be near the bottom of the base supporting shaft 180. The outer shaft housing 188 works to inhibit fluid tides or fluid splashing from breaching the top of the inner shaft housing 184 and entering the area containing the base supporting shaft 180, roller bearings 182, and window rotating mechanism 120. For example, a fluid in the fluid containing enclosure 130 may fill the fluid containing enclosure 130 up to a certain height of the outer shaft housing 188, such as around half way up the outer shaft housing 188. The fluid level will fill to the same height between the inner shaft housing 184 and the outer shaft housing 188. However, the fluid level between the inner shaft housing 184 and the outer shaft housing 188 will be less prone to height change due to splashing or tidal movements of the fluid, allowing for less likelihood of fluids entering the area around the base supporting shaft 180 and roller bearings 182.

The expelled fluid may then be drained from the fluid containing enclosure 130 through one or more fluid containing enclosure drains, which may be tubing, piping, or one or more channels. In one embodiment, the fluid may drain from the fluid containing enclosure through a drain pipe that leads directly to a fluid outlet valve 162. In another embodiment, the fluid may drain through a channel 161 into a drainage tray 163, which is impermeable to fluids and is in fluid communication with a fluid outlet valve 164 through a drain opening 165 and tubing 167. The drainage tray 163 may be disposed over the entire width and length of the frame 190 of the dielectric window cleaning apparatus 100 to capture any fluid which leaks out of the fluid containing enclosure or is sprayed outside of the fluid containing enclosure. A permeable plate 198 may allow drainage from areas above the plate 198 into the drainage tray 163 and does not allow fluid to enter the area comprising any electric part such as a pump, heat exchanger, or unit controller. The drainage tray 163 may comprise a sloped bottom, such as a 1° sloped angle bottom, which allows fluids to freely flow to the outlet drain 165 and tubing 167 to be expelled from the dielectric window cleaning apparatus 100. However, it should be understood that any adequate drainage system may be used, such that the electrical components are protected from fluid contact and the majority of the expelled fluids are contained within the dielectric window cleaning apparatus 100 and are then expelled from the dielectric window cleaning apparatus 100 through an outlet valve to leave the system.

Figure 2:
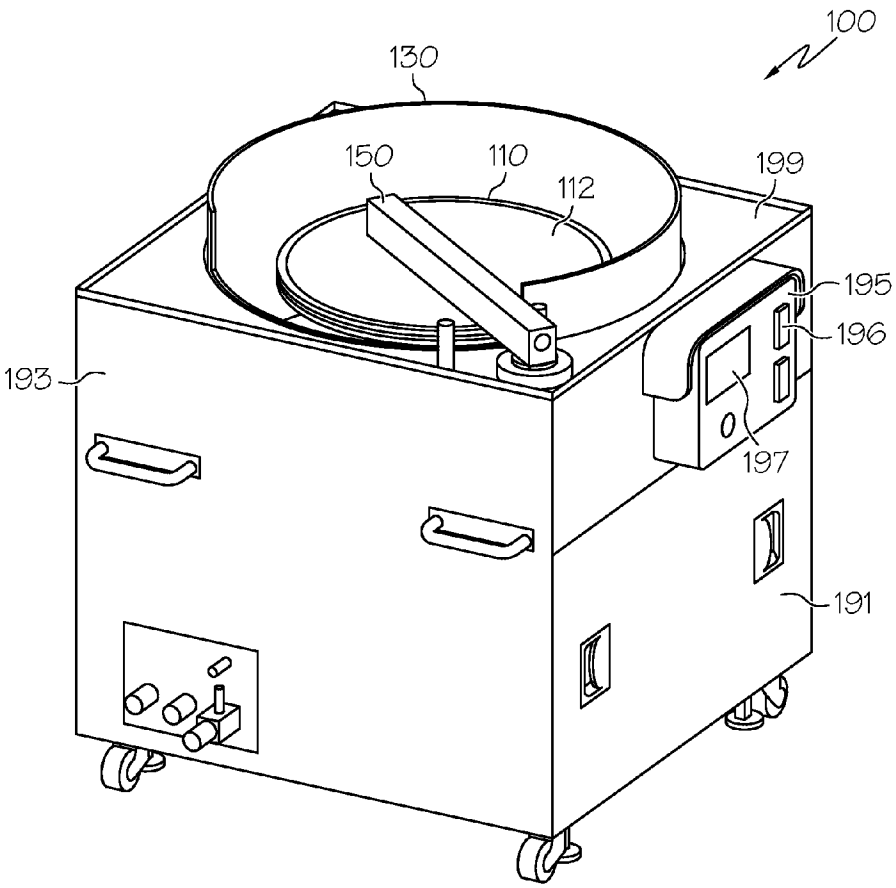
FIG. 2 illustrates a schematic view of the dielectric window cleaning apparatus with a dielectric window disposed on the window support base of FIG. 1 with outer casing fitted to the frame according to one or more embodiments described herein.

Now referring to FIG. 2, the dielectric window cleaning apparatus 100 may comprise one or more electrical control units 195. The control unit 195 may be electrically coupled to one or more components of the dielectric window cleaning apparatus 100 such as the window rotating mechanism, heat exchanger, and/or pump. The control unit 195 may comprise a display 197 in which information in displayed and user interface controls 196 which may receive input information and transmit that input information to the control unit 195. The control unit 195 may receive input information to turn on, turn off, or adjust settings of various components of the dielectric window cleaning apparatus 100. For example, input information may be received such as the rotation speed to the window rotating mechanism, fluid temperature to the heat exchanger, and/or fluid pressure settings to the pump. The control unit 195 may keep a time record of the cleaning process or may have a timer that can automatically shut off the dielectric window cleaning apparatus 100 after a set amount of time.

Referring now to FIG. 1, the various components of the dielectric window cleaning apparatus 100 may be disposed on a frame 190, which may comprise metal or any other suitable material. The frame may be in a cart shape, but may be any suitable shape to house and support the components of the dielectric window cleaning apparatus 100. The components may be attached to the frame 190 by any mechanical means, such as with screws, fasteners, by weld, or any other like means. The frame 190 may comprise stabilizing feet 194 which may stabilize and balance the dielectric window cleaning apparatus 100 on a surface such as a floor. The dielectric window cleaning apparatus 100 mounted on a frame 190 may be mobile, such as that the dielectric window cleaning apparatus 100 could be moved from one location to another in a cart like operation. In one embodiment, the frame 190 may comprise wheels 194, allowing the frame 190 to be rolled on the ground by a user in an industrial or laboratory setting.

Now referring to FIGS. 1 and 2, the dielectric window cleaning apparatus 100 may comprise outer paneling 191, 193 and a top panel 199 that attaches to the frame 190 and covers the outer sides of the dielectric window cleaning apparatus. In one embodiment, the outer paneling 191,193 and top panel 199 are impermeable to the fluid sprayed by the spray arm 150, allowing for the components inside of the frame 190, especially components with electrical connectivity, to be protected against malfunction due to exposure to the fluid. The paneling may be of any suitable material, such as plastic or metal.

Figure 9:
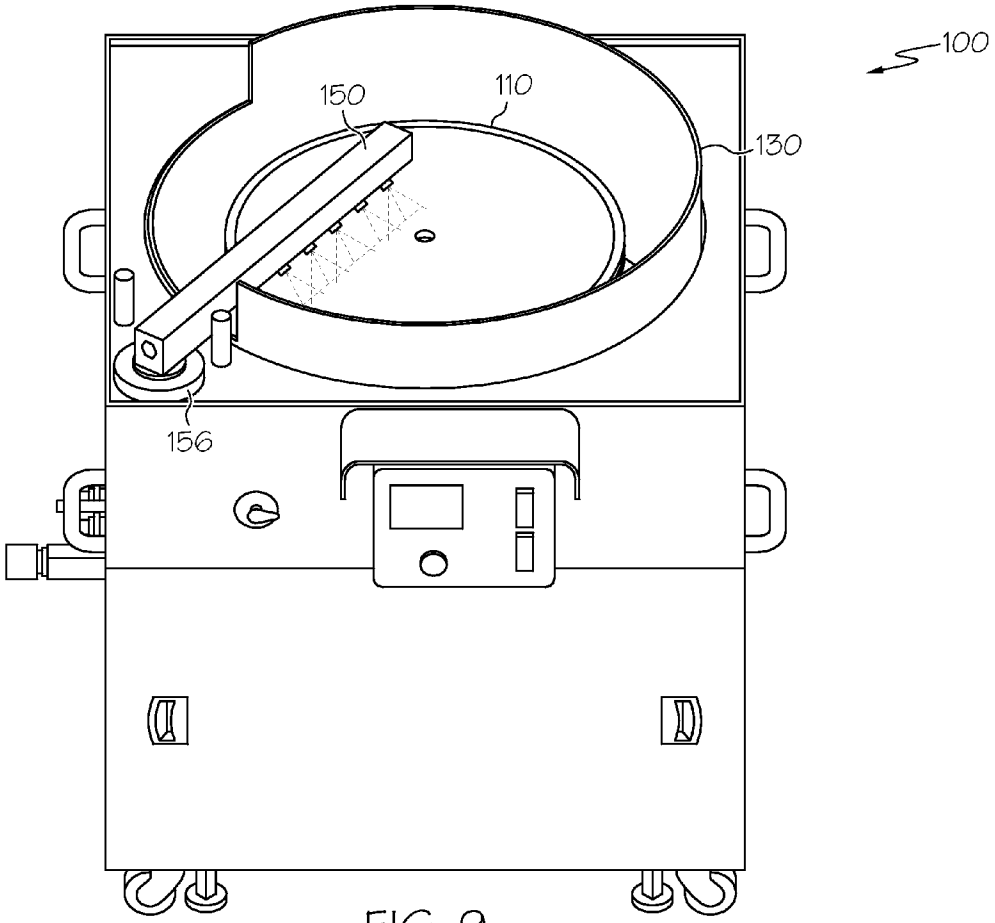
FIG. 9 illustrates a schematic view of the dielectric window cleaning apparatus of FIG. 2 in the operational position according to one or more embodiments described herein.

The operation of the dielectric window cleaning apparatus will now be described with reference to numerous figures herein. The dielectric window cleaning apparatus comprises an operational position and a loading position. FIG. 8 shows the dielectric window cleaning apparatus 100 in the loading position, wherein the spray arm 150 is not disposed directly above the window support base. FIG. 9 shows the dielectric window cleaning apparatus 100 in the operational position, wherein the spray arm 150 is at least partially disposed directly above the window support base. In the loading position of FIG. 8, the dielectric window can be positioned onto the window support base by a user without interference from the spray arm, allowing for loading of the dielectric window 110 prior to cleaning and unloading of the dielectric window 110 after cleaning.

Referring to FIGS. 1, 4, and 5, to clean the top surface of the dielectric window 112, the dielectric window 110 is positioned onto the window support base 170 while the dielectric window cleaning apparatus 100 is positioned in the loading position. The dielectric window cleaning apparatus 100 is then moved to the operational position, wherein the spray arm 150 is located at least partially over the dielectric window. The window support base 170 is then rotated by the window rotating mechanism 120, which rotates the dielectric window 110. While the dielectric window 110 is rotating, a window cleansing spray 106 is expelled from the spray arm 150. The window cleansing spray 106 washes the dielectric window 110 by dissolving contaminants located on the dielectric window's top surface 112. The wash may last a for a number of minutes, such as about 1 minute, about 2 minutes, about 3 minutes, about 5 minutes, about 10 minutes, about 15 minutes, or any time necessary to substantially clean the dielectric window 110 of contaminants on the top surface 112.

The window support base 170 may spin around its rotational axis, thus rotating a dielectric window 110 placed upon the window support base 170, at a rate between about 1 Hz and 150 Hz. In one embodiment, the window support base 170 can rotate between about 25 Hz and about 150 Hz. In another embodiment, the window support base 170 can rotate between about 70 Hz and about 80 Hz, and may rotate the window support base at about 75 Hz. However, it should be understood that the window support base 170 may be rotated at any speed suitable for cleaning the dielectric window 110.

The fluid that is sprayed 106,108 may be any fluid 106,108 capable of dissolving the contaminants present on the surface of the dielectric window 112. In one embodiment, the fluid 108 is de-ionized water (DIW), which may be heated to above room temperature. For example, the DIW may be heated to between about 65° C. and about 80° C. The fluid 108 may be pressurized by a pump 144 to affect the spray 106 expelled through the fluid spraying nozzles 154. In one embodiment, the fluid 108 is at a pressure of 25 psi prior to being expelled through the fluid spraying nozzles 154, and the overall flowrate from all fluid spraying nozzles 154 combined is 2 gallon/minute.

The dielectric window cleaning apparatus as described herein is capable of cleaning a dielectric window of contaminants which may routinely build up on a surface of the dielectric window through use in a plasma processing device. The apparatus and methods described herein allow the dielectric window to be cleansed on only one side, allowing for a cleaning process which does not contaminate the non-contaminated side of the dielectric window. Furthermore, the dielectric window cleaning apparatus allows for a dielectric window to be cleaned with minimal exposure to dielectric window contaminants.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter. It is noted that recitations herein of a component of the present disclosure being "configured" in a particular way, to embody a particular property, or function in a particular manner, are structural recitations, as opposed to recitations of intended use. More specifically, the references herein to the manner in which a component is "configured" denotes an existing physical condition of the component and, as such, is to be taken as a definite recitation of the structural characteristics of the component.

What is claimed is:

1. A dielectric window cleaning apparatus for cleaning a dielectric window of a plasma processing device wherein the dielectric window is used to transmit RF or microwave energy during plasma processing, the dielectric window cleaning apparatus comprising:

a window support base comprising a window contacting surface configured to support an underside of the dielectric window;

a fluid containing enclosure comprising at least one overflow containment sidewall, wherein the fluid containing enclosure is located at least partially under and at least partially around a portion of the window support base;

a window rotating mechanism operatively connected to the window support base, wherein the window rotating mechanism rotates the window support base;

a spray arm in fluid communication with a fluid source and comprising a fluid flow channel, wherein the spray arm comprises an operational position and a loading position, wherein when the spray arm is positioned in the operational position the fluid flow channel is at least partially disposed directly above the window support base, and when in the loading position the fluid flow channel is not disposed directly above the window support base; and multiple fluid spraying nozzles that each expel fluid from the fluid flow channel in a window cleansing spray, wherein the window cleansing spray from one of the fluid spraying nozzles overlaps with the window cleansing spray of at least another fluid spraying nozzle, and wherein the window cleansing spray forms a wall of fluid shaped to overlap and spray an upper surface of the dielectric window;

wherein the dielectric window cleaning apparatus is configured to clean the upper surface of the dielectric window from contaminants deposited on the dielectric window during plasma processing.

2. The dielectric window cleaning apparatus of claim 1, wherein the window contacting surface comprises at least one o-ring configured to prevent scratching of the underside of the dielectric window and form a seal between the underside of the dielectric window and the window contacting surface to prevent contact of the window cleansing spray from the underside of the dielectric window.

3. The dielectric window cleaning apparatus of claim 1, wherein the spray arm has pivoting movement wherein the spray arm pivots on a rotational axis between the operational position and the loading position.

4. The dielectric window cleaning apparatus of claim 3, wherein the pivoting movement of the spray arm is restricted by at least one spray arm guidepost.

5. The dielectric window cleaning apparatus of claim 1, wherein the dielectric window cleaning apparatus is configured to clean a dielectric window of a plasma processing device, with the dielectric window having a diameter of at least 20 inches and a weight of at least 40 pounds.

6. The dielectric window cleaning apparatus of claim 1, wherein there is between about 5% and about 50% overlap in the window cleansing spray of one of the multiple fluid spraying nozzles and the window cleansing spray of an adjacent one of the multiple fluid spraying nozzles.

7. The dielectric window cleaning apparatus of claim 6, wherein the window cleansing spray from each of the multiple fluid spraying nozzles is aligned.

8. The dielectric window cleaning apparatus of claim 6, wherein the window cleansing spray is not substantially perpendicular to the window contacting surface.

9. The dielectric window cleaning apparatus of claim 8, wherein the window cleansing spray is at an angle of between about 10° and about 50° relative to a line that is normal to the window contacting surface.

10. The dielectric window cleaning apparatus of claim 1, wherein the window cleansing spray comprises de-ionized water.

11. The dielectric window cleaning apparatus of claim 1, wherein the window cleansing spray has a temperature between about 65° C. and about 80° C.

12. The dielectric window cleaning apparatus of claim 1, wherein the window support base rotates at between about 25 Hz and about 150 Hz.

13. The dielectric window cleaning apparatus of claim 1, wherein the window support base comprises a base supporting shaft and the window rotating mechanism is operatively connected to the window support base at the base supporting shaft.

14. The dielectric window cleaning apparatus of claim 13, further comprising an inner shaft housing and an outer shaft housing, wherein:

the inner shaft housing partially surrounds the base supporting shaft;

the outer shaft housing partially surrounds the inner shaft housing and the base supporting shaft; and the outer shaft housing allows fluid flow towards the inner shaft housing only through a passage below the outer shaft housing.

15. The dielectric window cleaning apparatus of claim 1, wherein the window cleansing spray from each of the multiple fluid spraying nozzles has a substantially flat shape.

16. A dielectric window cleaning apparatus for cleaning a dielectric window of a plasma processing device, the dielectric window cleaning apparatus comprising:

a window support base comprising a window contacting surface having a window centering post shaped to mate with a cavity in the dielectric window;

a spray arm in fluid communication with a fluid source and comprising a fluid flow channel; and multiple fluid spraying nozzles that each expel fluid from the fluid flow channel in a window cleansing spray, wherein the window cleansing spray from one of the fluid spraying nozzles overlaps with the window cleansing spray of at least another fluid spraying nozzle;

and wherein:

each of the multiple fluid spraying nozzles expel a window cleansing spray; and there is between about 5% and about 50% overlap in the window cleansing spray of a fluid spraying nozzle and the window cleansing spray of an adjacent fluid spraying nozzle wherein the dielectric window cleaning apparatus is configured to clean the upper surface of the dielectric window.

17. The dielectric window cleaning apparatus of claim 16, wherein the window cleansing spray is at an angle of between about 10° and about 50° relative to a line that is normal to the window contacting surface.

18. A dielectric window cleaning apparatus for cleaning a dielectric window of a plasma processing device, the dielectric window cleaning apparatus comprising:

a window support base comprising a window contacting surface wherein the window contacting surface comprises at least one o-ring configured to prevent scratching of the underside of the dielectric window and form a seal between the underside of the dielectric window and the window contacting surface;

a fluid containing enclosure comprising at least one overflow containment sidewall, wherein the fluid containing enclosure is located at least partially under and at least partially around a portion of the window support base;

a window rotating mechanism operatively connected to the window support base, wherein the window rotating mechanism rotates the window support base;

a spray arm in fluid communication with a fluid source and comprising a fluid flow channel, wherein the spray arm comprises an operational position and a loading position, wherein when the spray arm is positioned in the operational position the fluid flow channel is at least partially disposed directly above the window support base, and when in the loading position the fluid flow channel is not disposed directly above the window support base; and multiple fluid spraying nozzles that each expel fluid from the fluid flow channel in a window cleansing spray, wherein the window cleansing spray from one of the fluid spraying nozzles overlaps with the window cleansing spray of at least another fluid spraying nozzle, and wherein the window cleansing spray forms a wall of fluid with a substantially flat shape;

wherein the dielectric window cleaning apparatus is configured to clean a dielectric window of a plasma processing device, with the dielectric window having a diameter of at least 20 inches and a weight of at least 40 pounds, and wherein the window contacting surface is substantially flat and the window support base further comprises a window centering post protruding from the window contacting surface, the window centering post contoured to fit a center cavity region of the underside of the dielectric window and restrict movement of the dielectric window relative to the window contacting surface when the dielectric window is positioned on the window contacting surface and rotated.

* * * * *